US009850627B2

(12) United States Patent
Seibel et al.

(10) Patent No.: US 9,850,627 B2
(45) Date of Patent: Dec. 26, 2017

(54) ROAD FINISHING MACHINE WITH VARIABLE SCREW SUSPENSION

(71) Applicant: JOSEPH VOEGELE AG, Ludwigshafen/Rhein (DE)

(72) Inventors: Martin Seibel, Bruchsal (DE); Thomas Schmidt, Plankstadt (DE)

(73) Assignee: JOSEPH VOEGELE AG (DE)

( * ) Notice: Subject to any disclaimer, the term of this patent is extended or adjusted under 35 U.S.C. 154(b) by 0 days.

(21) Appl. No.: 13/861,615

(22) Filed: Apr. 12, 2013

(65) Prior Publication Data

US 2013/0272789 A1 Oct. 17, 2013

(30) Foreign Application Priority Data

Apr. 13, 2012 (DE) ..... 20 2012 003 792 U

(51) Int. Cl.
*E01C 19/12* (2006.01)
*E01C 19/42* (2006.01)
*E01C 19/48* (2006.01)

(52) U.S. Cl.
CPC ..... *E01C 19/42* (2013.01); *E01C 19/48* (2013.01)

(58) Field of Classification Search
CPC ..... E01C 19/12; E01C 19/20; E01C 19/187
USPC ..... 404/101, 108, 110
See application file for complete search history.

(56) References Cited

U.S. PATENT DOCUMENTS 3,099,369 A * 7/1963 Schatz et al. ..... 222/238
3,997,277 A 12/1976 Swisher, Jr. et al.
4,545,531 A * 10/1985 Williams ..... A63C 19/08 118/305
4,708,519 A * 11/1987 Davin ..... E01C 19/4873 404/101
5,348,418 A * 9/1994 Campbell ..... 404/103
5,531,542 A * 7/1996 Willis ..... 404/101
6,905,059 B2 * 6/2005 Shafie ..... B23K 3/0623 228/245
7,100,704 B2 * 9/2006 Potter ..... 172/439
8,302,988 B2 * 11/2012 Noble ..... 280/681
2002/0141824 A1 * 10/2002 Wells ..... 404/118
2004/0146354 A1 7/2004 Goodwin et al.
2008/0063475 A1 * 3/2008 Utterodt et al. ..... 404/82

FOREIGN PATENT DOCUMENTS

CN 201137031 Y * 10/2008
EP 1120495 A1 8/2001
JP S63108412 U 7/1988
WO 9220865 A1 11/1992

OTHER PUBLICATIONS

European Search Report dated Feb. 22, 2017, Application No. 13001822.9-1614, Applicant Joseph Voegele AG, 7 Pages.

* cited by examiner

*Primary Examiner* — Robert Pezzuto
*Assistant Examiner* — Katherine Chu
(74) *Attorney, Agent, or Firm* — Brooks Kushman P.C.

(57) ABSTRACT

A road finishing machine comprises a chassis, a screw bearing arrangement for receiving a spreading screw, and first and second perforated supports at the chassis to fix the screw bearing arrangement to the chassis. The first and the second perforated supports each comprise first and second hole patterns to fix different screw bearing arrangements to the road finishing machine by means of the first hole pattern or by means of the second hole pattern.

14 Claims, 4 Drawing Sheets

ROAD FINISHING MACHINE WITH VARIABLE SCREW SUSPENSION

CROSS-REFERENCE TO RELATED APPLICATIONS

This application claims foreign priority benefits under 35 U.S.C. §119(a)-(d) to German patent application number DE 20 2012 003 792.7, filed Apr. 13, 2012, which is incorporated by reference in its entirety.

TECHNICAL FIELD

The present disclosure relates to a road finishing machine.

BACKGROUND

In practice, a spreading screw is fixed to a road finishing machine by a screw bearing arrangement. The screw bearing arrangement is needed to position the spreading screw at an appropriate distance to the foundation. A correct positioning of the spreading screw relative to the foundation is important to spread the laying material at preferably high efficiency and possibly prevent segregations in the laying material.

Conventionally, for different models of road finishing machines, different screw bearing arrangements were used. This gave rise to an increased warehousing demand. Moreover, due to the manufacture of different screw bearing arrangements, manufacturing costs increased.

SUMMARY

It is an object of the present disclosure to improve a road finishing machine by means of simple constructive technical features such that different screw bearing arrangements can be easily attached to it.

The disclosure relates to a road finishing machine with a chassis and a screw bearing arrangement for receiving a spreading screw, comprising a first and a second perforated support at the chassis to fix the screw bearing arrangement to the chassis.

According to the disclosure, the first and the second perforated supports each comprise a first and second hole patterns to fix different screw bearing arrangements to the road finishing machine by means of the first hole pattern or by means of the second hole pattern.

The inventive road finishing machine offers the technical advantage that, independent of the series, different screw bearing arrangements can be attached to it e.g., depending on the engine output of the finishing machine.

Preferably, it is provided for the first and the second hole patterns to each comprise a group of bores. This permits to arrange the screw bearing arrangement at different heights relative to the foundation.

According to another design, the bores of the first and the second hole patterns are each equidistantly spaced apart. Thereby, an operator can simply fix the screw bearing arrangement to the road finishing machine as he desires.

The vertical adjustments for the screw bearing arrangement can be particularly easily differentiated if the first and the second hole patterns extend to be offset in parallel with respect to each other.

It is also advantageous for the first and the second hole patterns to each be connectable by means of a lifting cylinder to thereby fix the screw bearing arrangement to the chassis of the road finishing machine. Thereby, the screw bearing arrangement can be continuously lifted to different heights relative to the foundation.

To be applicable in a particularly flexible manner, it is preferably provided for the screw bearing arrangement to be fixed to the first hole pattern when a spreading screw with a first screw flight diameter is arranged in the screw bearing arrangement, and to be fixed to the second hole pattern, when a spreading screw with a second screw flight diameter which is smaller than the first one is arranged in the screw bearing arrangement. Thereby, the screw bearing arrangement can be excellently used with different spreading screws.

The present disclosure will be illustrated more in detail with reference to the below described drawings.

DETAILED DESCRIPTION

Figure 1:
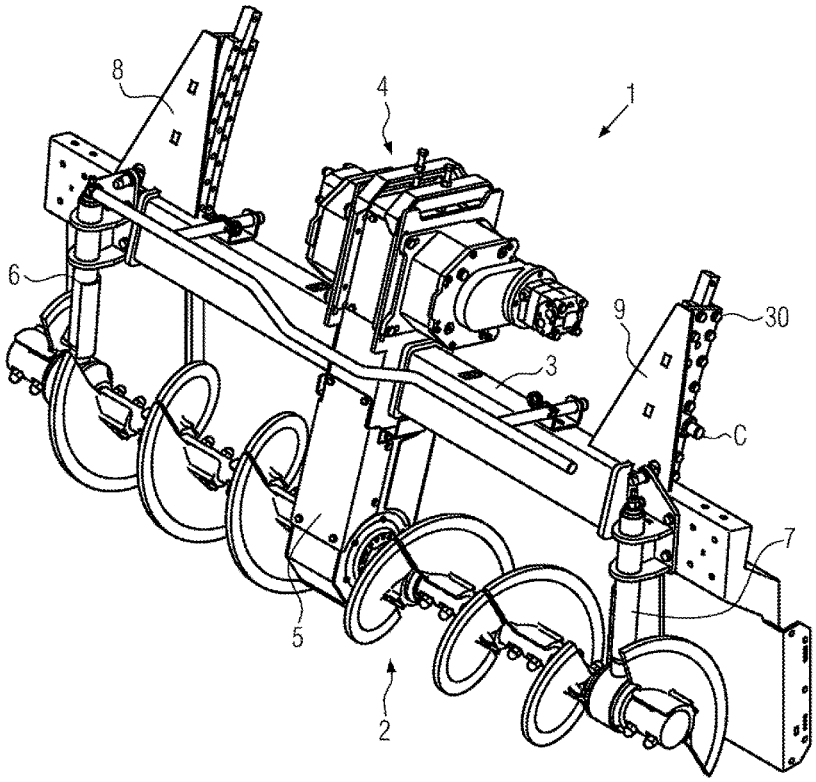
FIG. 1 shows a screw bearing arrangement for a road finishing machine according to the disclosure.

FIG. 1 shows a screw bearing arrangement 1 which can be attached to a road finishing machine in accordance with the disclosure. A spreading screw 2 is mounted at the screw bearing arrangement 1. The screw bearing arrangement 1 comprises a crossbar 3. A drive 4 is fixed on the crossbar 3. The drive 4 can be a hydraulic motor. The drive 4 is functionally coupled to the spreading screw 2 via a gear 5 to achieve the desired spreading power.

In FIG. 1, the spreading screw 2 is fixed to the crossbar 3 by a first and a second screw conveyor support 6, 7. A first and a second guide 8, 9 provided for fixing the screw bearing arrangement 1 extend from the crossbar 3. The first and the second guides 8, 9 each comprise pins 30 to fix the screw bearing arrangement 1 to the road finishing machine.

Figure 2:
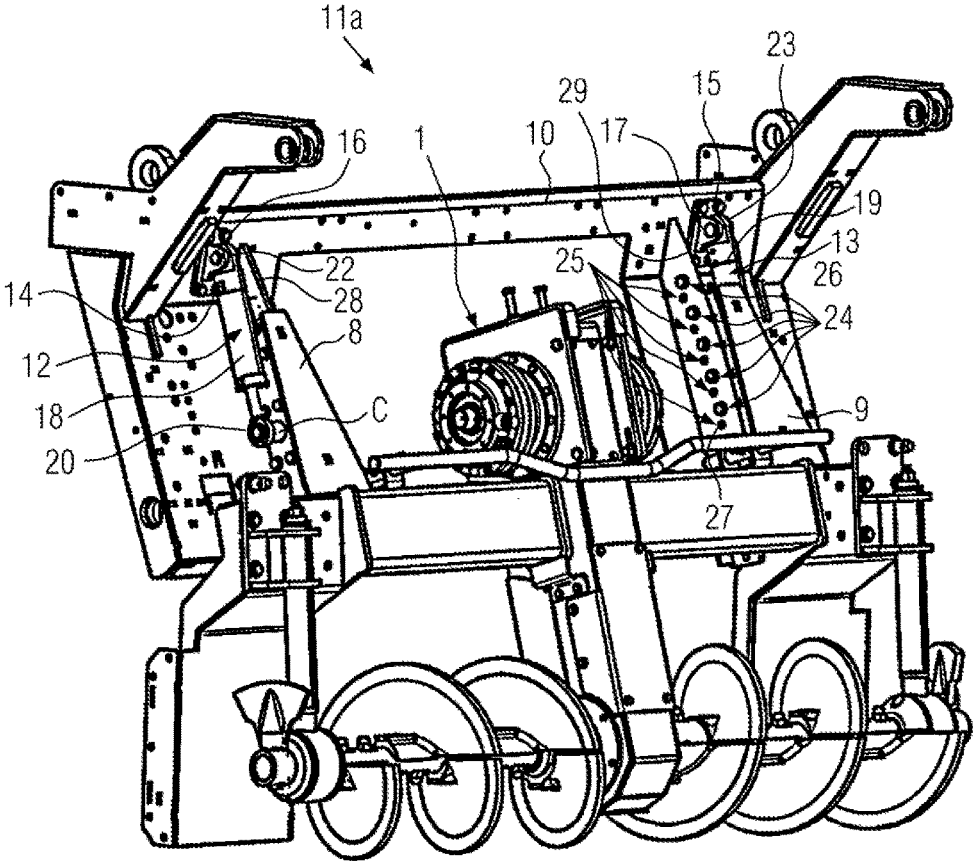
FIG. 2 shows the screw bearing arrangement at the chassis of a first road finishing machine model according to the disclosure.

FIG. 2 shows the screw bearing arrangement 1 which is fixed to a chassis 10 of a road finishing machine 100, in particular to a chassis 10 of a first road finishing machine model 11*a*. The screw bearing arrangement 1 is fixed to the chassis 10 of the road finishing machine model 11*a* by a first and a second lifting cylinder 12, 13.

The first and the second lifting cylinders 12, 13 each comprise a retaining plate 14, 15. The two retaining plates 14, 15 are permanently or detachably screwed to the chassis 10. A fastening projection 16, 17 extends from the retaining plates 14, 15, which is inclined relative to the respective retaining plate 14, 15. In FIG. 2, in the first road finishing machine model 11*a*, each inclined fastening projection 16, 17 is inclined upwards relative to the respective retaining plate 14, 15.

The first lifting cylinder 12 comprises a first cylinder 18, and the second lifting cylinder 13 comprises a second cylinder 19. Moreover, the two lifting cylinders 12, 13 each comprise a piston 20, 21, where in FIG. 2, only the piston 20 of the first lifting cylinder 12 is visible. Each piston 20, 21 is fixed to a respective guide 8, 9 of the screw bearing arrangement 1 via a coupling member C.

In the first road finishing machine model 11*a* according to FIG. 2, the first and the second lifting cylinders 12, 13 are each fixed to the chassis 10 such that the fastening projections 16, 17 each point upwards, so that the lifting cylinders 12, 13 are fixed to the respective guides 8, 9 such that the screw bearing arrangement 1 is positioned at a first level.

A first bearing 22 is provided at the first fastening projection 16, and a second bearing 23 is provided at the second fastening projection 17 to movably fasten the first and the second cylinders 18, 19 to the respective fastening projections 16, 17.

FIG. 2 also shows a first and a second perforated support 28, 29 at the chassis 10 in which each a first hole pattern 24 and a second hole pattern 25 are embodied. In the first road finishing machine model of FIG. 2, the first and the second lifting cylinders 12, 13 are fixed to the first hole pattern 24. The first hole pattern 24 comprises several equidistantly spaced apart bores 26. The second hole pattern 25 comprises equidistantly spaced apart bores 27. The bores 26 of the first hole pattern 24 are provided at the respective perforated supports 28, 29 offset in parallel relative to the bores 27 of the second hole pattern 25.

Figure 3:
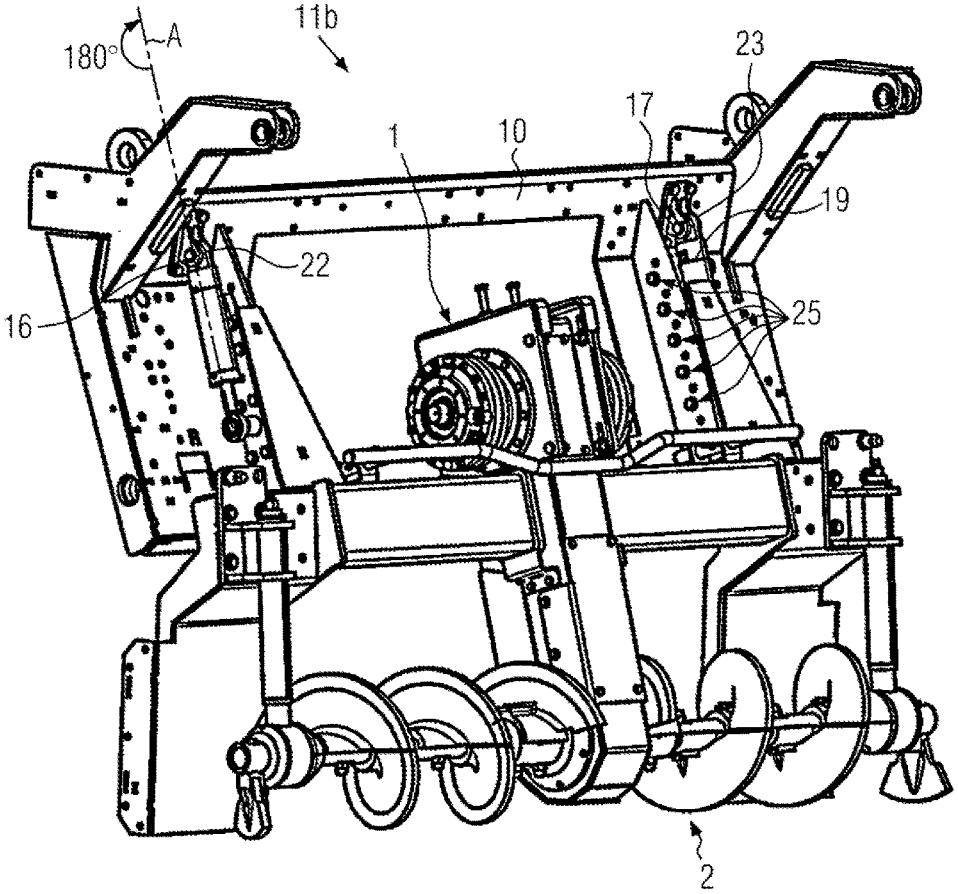
FIG. 3 shows the screw bearing arrangement at the chassis of a second road finishing machine model according to the disclosure.

FIG. 3 shows the screw bearing arrangement 1 fixed to the chassis 10 of a second road finishing machine model 11*b*, while in contrast to FIG. 2, the first and the second lifting cylinders 12, 13 are arranged relative to the chassis 10 in a way different from that in FIG. 2. Indeed, the first and the second fastening projections 16, 17 are inclined downwards here. Thereby, the first and the second bearings 22, 23 are arranged relative to the chassis 10 deeper compared to the representation of FIG. 2.

In the second road finishing machine model according to FIG. 3, the two lifting cylinders 12, 13 are fixed in the second hole pattern 25 of the respective perforated supports 28, 29. While according to FIGS. 2 and 3, different road finishing machine models 11*a*, 11*b* are shown, the screw bearing arrangement 1 can be easily arranged at both road finishing machine models 11*a*, 11*b* by means of the two provided hole patterns 24, 25, even if the lifting cylinders 12, 13 are fixed in different mounting positions at the chassis 10 of the first and the second road finishing machine models 11*a*, 11*b*.

Moreover, FIG. 3 shows that the first and the second lifting cylinders 12, 13 are each mounted along an orientation axis A to fix the screw bearing arrangement 1 to the chassis 10. Relative to the orientation axis A, the lifting cylinders 12, 13 of the first road finishing machine model 11*a* are rotated by 180 degrees compared to the lifting cylinders 12, 13 of the second road finishing machine model 11*b*. By the rotation of the respective lifting cylinders 12, 13 by 180 degrees about axis A, the lifting cylinders 12, 13 of the first road finishing machine model 11*a* with the first hole pattern 24 of the respective perforated supports 28, 29, and the lifting cylinders 12, 13 of the second road finishing machine model 11*b* with the second hole pattern 25 of the respective perforated supports 28, 29 can be connected. This permits to attach the screw bearing arrangement 1 to different road finishing machine models, where a spreading screw can be each positioned at a desired distance above the foundation.

Figure 4:
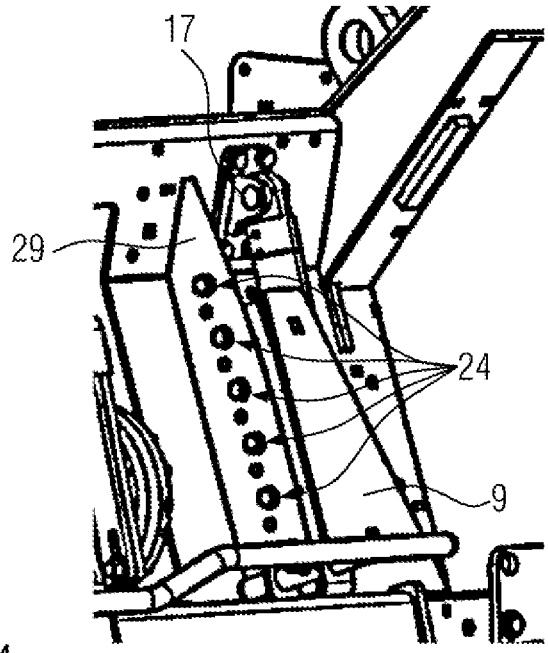
FIG. 4 shows the lifting cylinder at the first road finishing machine model.

FIG. 4 shows an enlarged detail of FIG. 2 according to which the second lifting cylinder 13 is fixed to the first hole pattern 24 of the second perforated support 29 to support a spreading screw 2 arranged in the screw bearing arrangement 1 and having a first screw flight diameter. The fastening projection 17 of the second lifting cylinder 13 is inclined upwards.

Figure 5:
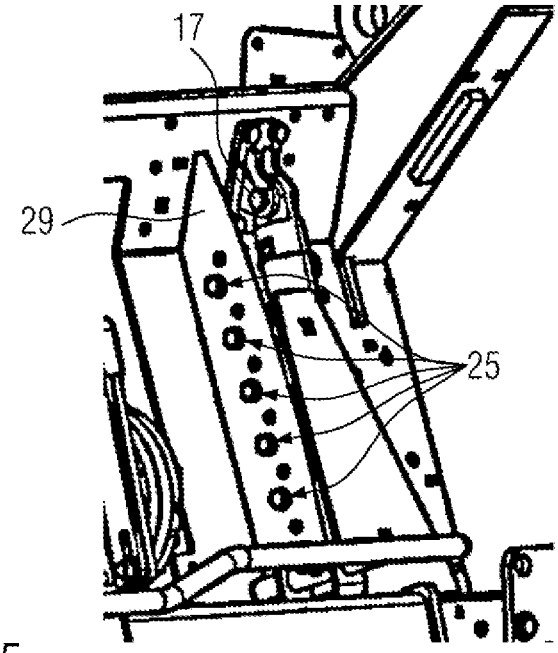
FIG. 5 shows the lifting cylinder at the second road finishing machine model.

FIG. 5 shows an enlarged detail of FIG. 3 according to which the second lifting cylinder 13 is fixed in the second hole pattern 25 of the second perforated support 29 to support a spreading screw 2 arranged in the screw bearing arrangement 1 and having a second screw flight diameter which is smaller than the first one. According to FIG. 5, the fastening projection 17 is inclined downwards.

While FIGS. 2 to 5 relate to first and second road finishing machine models 11*a*, 11*b*, respectively, the use of the screw bearing arrangement 1 is not restricted to it. The disclosure rather provides a road finishing machine to which different screw bearing arrangements can be attached at a desired level relative to the foundation independent of their series.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A road finishing machine comprising:

a chassis:

a screw bearing arrangement for receiving a spreading screw; and first and second perforated supports a the chassis to fix the screw bearing arrangement to the chassis, wherein the first and the second perforated supports each comprise first and second hole patterns to fix the screw bearing arrangement to the chassis by means of the first hole pattern or by means of the second hole pattern, wherein the screw bearing arrangement is configured to be fixed to the first hole pattern when a spreading screw with a first screw flight diameter is arranged in the screw bearing arrangement, and the screw bearing arrangement is configured to be fixed to the second hole pattern when a spreading screw with a second screw flight diameter which is smaller than the first screw flight diameter is arranged in the screw bearing arrangement, and wherein, for each perforated support, the first and the second hole patterns extend offset in parallel with respect to each other;

wherein the screw bearing arrangement includes a laterally extending crossbar, first and second guide members that extend upwardly from the crossbar, and a drive supported on the crossbar for driving each spreading screw, the drive being positioned between the guide members, wherein each perforated support is configured to extend along a lateral side of a respective guide member when the screw bearing arrangement is fixed to the chassis, and wherein the first and second guide members are configured to be fixed to the first hole patterns of the first and second perforated supports, respectively, when the spreading screw with the first screw flight diameter is arranged in the screw bearing arrangement, and the first and second guide members are configured to be fixed to the second hole patterns of the first and second perforated supports, respectively, when the spreading screw with the second screw flight diameter is arranged in the screw bearing arrangement.

2. The road finishing machine according to claim 1 wherein the first and the second hole patterns each comprise a group of bores.

3. The road finishing machine according to claim 2 wherein the bores of the first hole pattern are equidistaiuly spaced apart, and the bores of the second hole pattern are equidistantly spaced apart.

4. The road finishing machine according to claim 1 wherein the first and the second hole patterns can each be connected to a lifting cylinder to fix the screw bearing arrangement to the chassis of the road finishing machine by means of the cylinders.

5. The road finishing machine according to claim 1 wherein, for each of the first and second perforated supports, the first and second hole patterns extend laterally through the perforated support.

6. The road finishing machine according to claim 1 wherein the screw bearing arrangement further comprises first and second screw conveyor supports that are connectable with opposite ends of each spreading screw for attaching each spreading screw to the crossbar.

7. A road finishing machine comprising:

a chassis; and first and second perforated supports at the chassis for fixing a screw bearing arrangement to the chassis, wherein the first and second perforated supports each comprise first and second hole patterns for fixing the screw bearing arrangement to the chassis, the first hole pattern being configured for fixing the screw bearing arrangement with respect to the chassis when a spreading screw with a first screw flight diameter is arranged in the screw bearing arrangement, and the second hole pattern being configured for fixing the screw bearing arrangement with respect to the chassis when a spreading screw with a second screw flight diameter which is smaller than the first screw flight diameter is arranged in the screw bearing arrangement, and wherein, for each perforated support, the first and second hole patterns extend offset in parallel with respect to each other;

wherein the screw bearing arrangement includes a laterally extending, crossbar, first and second guide members that extend upwardly from the crossbar, and a drive supported on the crossbar for driving each spreading screw, the drive being positioned between the guide members, wherein each perforated support is configured to extend along a lateral side of a respective guide member when the screw bearing arrangement is fixed to the chassis, and wherein the first and second guide members are releasably attached to the first and second perforated supports, respectively, when the screw bearing arrangement is fixed to the chassis, and wherein the first and second guide members are configured to be fixed to the first hole patterns of the first and second perforated supports, respectively, when the spreading screw with the first screw flight diameter is arranged in the screw bearing arrangement, and the first and second guide members are configured to be fixed to the second hole patterns of the first and second perforated supports, respectively, when the spreading screw with the second screw flight diameter is arranged in the screw bearing arrangement.

8. The road finishing machine according to claim 7 wherein, for each of the first and second perforated supports, the first and second hole patterns extend laterally through the perforated support.

9. The road finishing machine according to claim 7 further comprising first and second tiffing cylinders for connecting the screw bearing arrangement to the chassis, wherein each lifting cylinder comprises a retaining plate configured to be detaehably connected to the chassis, a fastening projection extending from the retaining plate and inclined relative to the retaining plate, and a piston configured to be releasably mounted to a respective one of the first and second guide members by a coupling member, wherein each lifting cylinder is configured to be mounted along an orientation axis for fixing the screw bearing arrangement to the chassis, each lifting cylinder being configured to be mounted to the chassis in a first orientation along the respective orientation axis with the respective fastening projection being inclined upwards tor attaching the first and second guide members to the first hole patterns of the first and second perforated supports, respectively, and each lifting cylinder being configured to be mounted to the chassis in a second orientation along the respective orientation axis, wherein in the second orientation each lifting cylinder is rotated by 180 degrees about the respective orientation axis relative to the first orientation with the respective fastening projection being inclined downwards for attaching the first and second guide members to the second hole patterns of the first and second perforated supports, respectively.

10. A road finishing machine comprising:

a chassis;

a screw bearing arrangement for receiving a spreading screw; and first and second perforated supports at the chassis to fix the screw bearing arrangement to the chassis, wherein the first and second perforated supports each comprise first and second hole patterns to fix the screw bearing arrangement to the chassis by means of the first hole pattern or by means of the second hole pattern, wherein the first and second hole patterns are each connectable to a lifting cylinder to fix the screw bearing arrangement to the chassis of the road finishing machine by means of the cylinders, and wherein the screw bearing arrangement is configured to be fixed to the first hole pattern when a spreading screw with a first screw flight diameter is arranged in the screw bearing arrangement, and the screw bearing arrangement is configured to be fixed to the second hole pattern when a spreading screw with a second screw flight diameter which is smaller than the first screw llight diameter is arranged in the screw hearing arrangement, wherein for each perforated support, the first and second hole patterns extend offset in parallel with respect to each other;

wherein the screw bearing arrangement includes a laterally extending crossbar, first and second guide members that extend upwardly from the crossbar, and a drive supported on the crossbar for driving each spreading screw, the drive being positioned between the guide members, wherein each perforated support is configured to extend along a lateral side of a respective guide member when the screw bearing arrangement is fixed to the chassis, and wherein the first and second guide members are releasably attached to the first and second perforated supports, respectively, when the screw bearing arrangement is fixed to the chassis, and wherein the first and second guide members are configured to be fixed tot he first hole patterns of the first and second perforated supports, respectively, when the spreading screw with the first screw flight diameter is arranged in the screw bearing arrangement, and the first and second quide members are configured to be fixed to the second hole patterns of the first and second perforated supports, respectively, when the spreading screw with the second flight diameter is arranged in the screw bearing arangement;

wherein each lifting cylinder comprises a retaining plate configured to be detachably screwed to the chassis, a fastening projection extending from the retaining plate and inclined relative to the retaining plate, and a piston configured to he releasably mounted to a respective one of the first and second guide members by a coupling member, wherein each lifting cylinder is configured to be mounted along an orientation axis for fixing the screw bearing arrangement to the chassis, each lifting cylinder being configured to be mounted in a first orientation along the respective orientation axis to the chassis with the respective fastening projection being inclined upwards for attaching the first and second guide members to the first hole patterns of the first and second perforated supports, respectively, such that the screw bearing arrangement is positioned at a first level, and each lifting cylinder being configured to be mounted in a second orientation along the respective orientation axis to the chassis, wherein in the second orientation each lifting cylinder is rotated by 180 degrees about the respective orientation axis relative to the first orientation, with the respective fastening projection being inclined downwards for attaching the first and second guide members to the second hole patterns of the first and second perforated supports, respectively, such that the screw bearing arrangement, is positioned at a second level, and wherein the second level is lower than the first level.

11. The road finishing machine according to claim 10 wherein the first and second hole patterns each comprise a group of bores.

12. The road finishing machine according to claim 11 wherein the bores of the first hole pattern are equidistantly spaced apart, and the bores of the second hole pattern are equidistantly spaced apart.

13. The road finishing machine according to claim 11 wherein, for each perforated support, the first and second hole patterns extend offset in parallel with respect to each other.

14. The road finishing machine according to claim 10 wherein the screw bearing arrangement farther comprises lirst and second screw conveyor supports ihut are connectable with opposite ends of each spreading screw for attaching each spreading screw to the crossbar.

* * * * *